US007942428B2

(12) United States Patent
Starr

(10) Patent No.: US 7,942,428 B2
(45) Date of Patent: May 17, 2011

(54) SPARK-EMITTING DEVICE FOR A SKATEBOARD

(75) Inventor: Gregory Scott Starr, Montecito, CA (US)

(73) Assignee: 3 Guys on Fire, Inc., Golden, CO (US)

( * ) Notice: Subject to any disclaimer, the term of this patent is extended or adjusted under 35 U.S.C. 154(b) by 0 days.

(21) Appl. No.: 10/934,721

(22) Filed: Sep. 7, 2004

(65) Prior Publication Data

US 2005/0127630 A1 Jun. 16, 2005

Related U.S. Application Data

(60) Provisional application No. 60/530,473, filed on Dec. 16, 2003.

(51) Int. Cl.
*A63C 17/26* (2006.01)
*B62M 1/00* (2010.01)

(52) U.S. Cl. ..... 280/11.203; 280/87.042

(58) Field of Classification Search ..... 280/11.203, 280/816, 87.01, 87.021, 87.041, 87.042, 280/22, 23; 446/22, 23
See application file for complete search history.

(56) References Cited

U.S. PATENT DOCUMENTS

| | | | | | |
|---|---|---|---|---|---|
| 2,389,198 | A * | 11/1945 | Kent | 420/416 |
| 4,834,407 | A * | 5/1989 | Salvo | 280/87.042 |
| 5,048,897 | A * | 9/1991 | Yeh | 301/5.301 |
| 5,460,390 | A * | 10/1995 | Miller | 280/11.208 |
| 5,921,653 | A * | 7/1999 | Chien | 362/103 |
| 6,059,315 | A * | 5/2000 | Selph | 280/809 |
| 2003/0151214 | A1 * | 8/2003 | Chen | 280/11.209 |
| 2004/0000768 | A1 * | 1/2004 | Miller | 280/87.042 |

* cited by examiner

*Primary Examiner* — J. Allen Shriver, II
*Assistant Examiner* — John R Olszewski
(74) *Attorney, Agent, or Firm* — Schmeiser, Olsen & Watts LLP

(57) ABSTRACT

A spark-emitting device for a skateboard. The spark-emitting device includes a housing and a plurality of misch metal barrels inserted into a housing and spaced apart so that the wear rate of the housing in the misch metal barrels is compatible and a desired sparking effect is achieved.

16 Claims, 2 Drawing Sheets

SPARK-EMITTING DEVICE FOR A SKATEBOARD

CROSS REFERENCE TO RELATED APPLICATION

The present application claims priority to U.S. Provisional Patent Application Ser. No. 60/530,473, filed Dec. 16, 2003, the entire contents of which are incorporated herein by reference.

BACKGROUND OF THE INVENTION

1. Field of the Invention

The present invention is directed to a spark-emitting device that attaches to any part of a skateboard and upon contact with any abrasive surface, emits a sparking effect.

2. Description of the Related Art

Skateboarding is the fastest growing "extreme" sport in the U.S. since 1998. This growth has occurred because of the overall action sports trend, the activity's appeal as a spectator sport, expanding TV coverage for skateboarding, and its high visibility in the videogame market.

Many of the maneuvers performed by a skateboard require abrupt changes in direction and/or speed. In a blur of flying acrobatics, skaters leap and skid over and onto obstacles, executive flips and turns of ever-increasing complexity, and all at top speeds. Some of these tricks are performed when the rider places his or her foot used to propel the skateboard on the rear portion of the board causing it to pin downward and engage the surface underneath the skateboard with the bottom surface of the skateboard itself. When the bottom surface of the board contacts the usually abrasive surface underneath the skateboard, friction is created and the traveling speed and/or direction of the skateboard is altered.

U.S. Pat. No. 4,834,407 (the '407 patent) proposes that a pyrotechnic device be attached to the bottom surface of the skateboard which contacts the abrasive surface such that a sparking effect is emitted when these two items contact each other. The pyrotechnic device of the '407 patent comprises a housing structure having a flat base member and a plurality of vertical integral fins evenly spaced from each other. The fins each include at least one open-ended port for housing a spark emitter. The spark emitters are made from flint or other material which provides a spark when engaged with an abrasive surface.

One of the main drawbacks to the pyrotechnic device disclosed in the '407 patent is that, because of the configuration and spacing of the vertical integral fins, the concentration of the sparks emitted from the pyrotechnic device are less than desirable. In particular, the concentration of the sparks emitted from the pyrotechnic device do not produce a satisfying effect for the riders of the skateboard, or the observers.

Accordingly, there remains a need to provide a pyrotechnic device which emits a sparking effect, which is both desirable to the rider of the skateboard as well as an observer.

SUMMARY OF THE INVENTION

The spark-emitting device of the present invention solves the above-mentioned problems by providing a unique sparking device composed of a misch metal alloy placed within a housing and attached to any part of a skateboard via double-sided tape. The housing is preferably made of a plastic material with a plurality of misch metal barrels inserted into respective openings within the housing. Preferably, the housing is composed of a polycarbonate material to provide a sufficient wear rate relative to the misch metal barrels.

To obtain the desired effect of having a superior concentration of sparks emitted from the device, as well as providing for a proper "wearing" of the misch metal barrels and the housing so that the misch metal barrels are not prematurely released from their openings within the housing, the present inventors have discovered that the spacing between adjacent misch metal barrels relative to the diameter of the barrels and the spacing between the barrels and edges of the housing are critical to the wearing of the device and the length and concentration of the sparks emitted therefrom. Accordingly, the width of the housing material located between adjacent barrels is preferably at most ⅓ of the diameter of the misch metal barrel. Most preferably, the width of the housing material located between adjacent barrels is approximately ⅙ of the diameter of the barrels. Likewise, the width of the housing material between the barrels and edges of the housing is also preferably at most ⅓ of the diameter of the barrels, and most preferably approximately ⅙ of the diameter of the barrels. With these ratios, the wearing of the housing material and the misch metal barrels, as well as the length and contraction of the sparks emitted, is maximized.

BRIEF DESCRIPTION OF THE DRAWINGS

For the purpose of illustrating the invention, there is shown in the drawings a form which is presently preferred, it being understood, however, that the invention is not limited to the specific arrangements and instrumentalities shown.

Other features and advantages of the present invention will become apparent from the following description of the invention that refers to the accompanying drawings, in which.

DESCRIPTION OF PREFERRED EMBODIMENTS OF THE INVENTION

Figure 1:
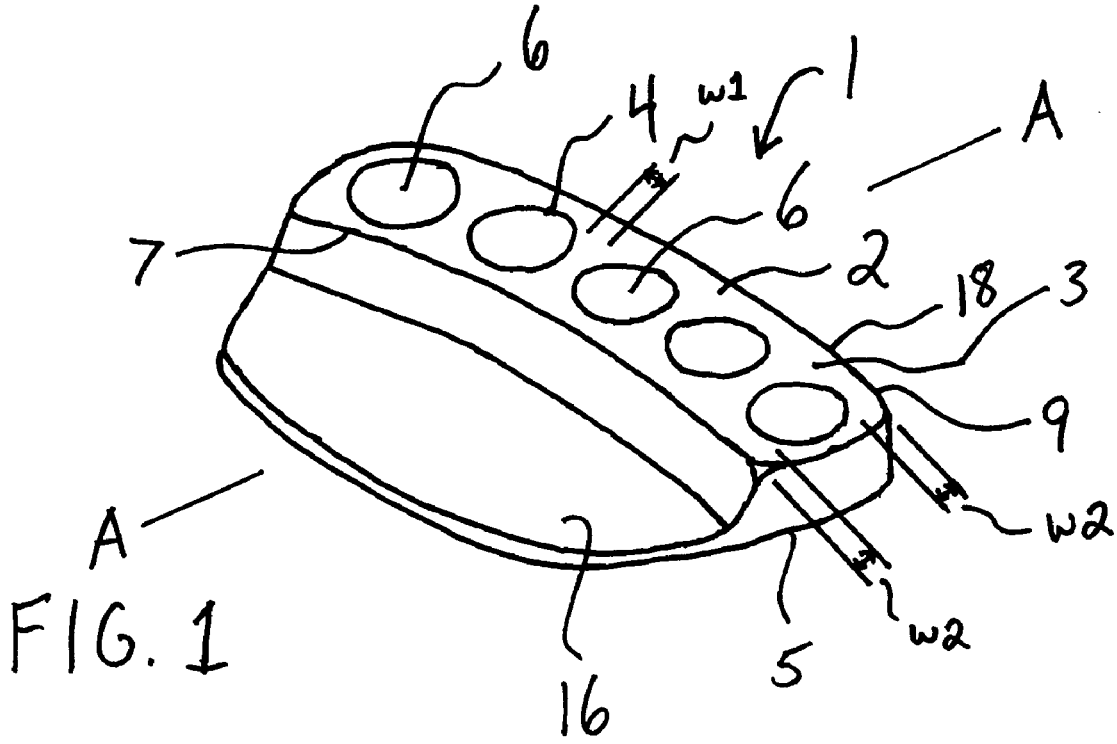
FIG. 1 is a perspective view of the spark-emitting device according to the present invention.
Figure 2:
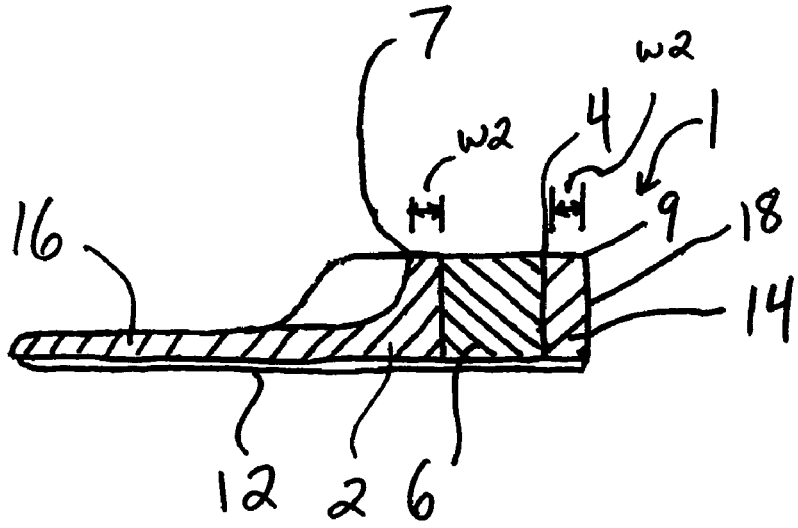
FIG. 2 is a cross-section along line A-A of the spark-emitting device shown in FIG. 1.
Figure 3:
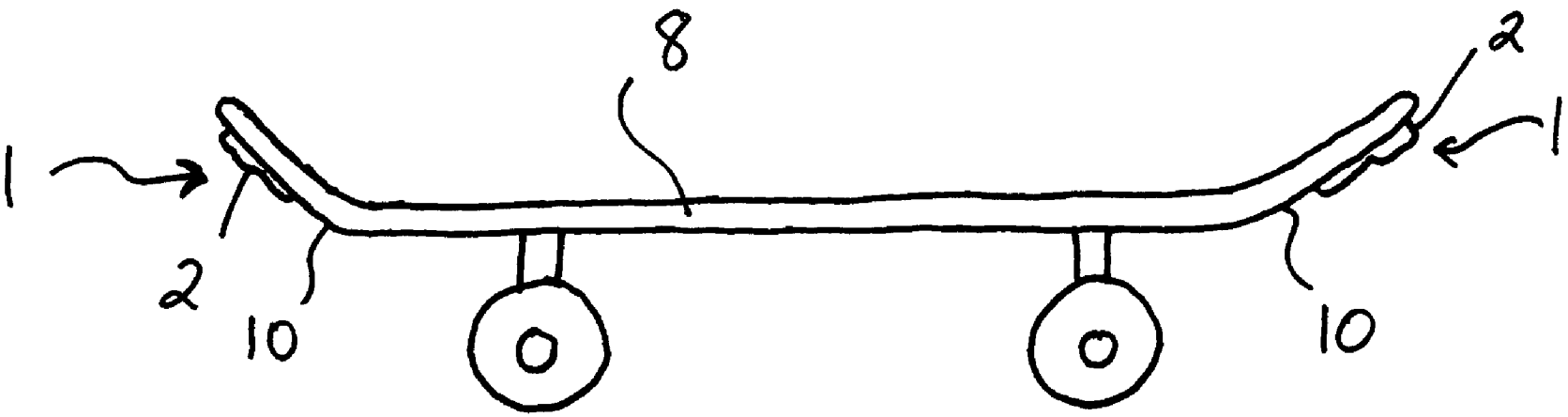
FIG. 3 shows the spark-emitting device of the present invention attached to a skateboard.

Referring now to the drawings, wherein like reference numerals represent like elements, FIGS. 1-3 show a preferred embodiment of the spark-emitting device of the present invention.

As described herein, the spark-emitting device of the present invention uses a special flint-like material which is sufficiently soft to emit elongated sparks, yet hard enough to wear slowly and not break under pressure or abrasion. Thus, due to the arrangement of the spacing of the misch metal barrels and the material used for the housing, the desired combination of wear rate and spark concentration is achieved. In addition, the misch metal barrel material is designed so as to maintain a low heat level in use so as to not melt the plastic base.

As shown in FIGS. 1-2, the spark-emitting device 1 comprises a housing 2 having an upper surface 3 and a lower surface 5 having a plurality of openings 4 therein which extend from the upper surface 3 proximate to the lower surface 5. Respective misch metal barrels 6 are inserted into each of the openings 4 in the housing 2. The misch metal barrels 6 create a sparking effect when in contact with an abrasive surface.

Preferably, the housing 2 is made of a plastic material, such as a polycarbonate material, which wears at least as fast as the misch metal barrels 6, which are contained in the housing 2. The housing material preferably wears no faster than 3/16 of an inch in 20 minutes of use under a 120 pounds of pressure. The product wear rate determines product life, but wear speed dictates the amount of spark created. Thus, there is a critical balance between wear rate and spark level.

In order to create an adequate spark level versus usage, there are preferably five misch metal barrels 6 each arranged side-by-side within the housing 2. Preferably, each of the misch metal barrels 6 are 3/8 of an inch in diameter and 1/4 of an inch in depth.

As described above, the housing 2 includes a plurality of openings 4 which are designed to accept the misch metal barrels 6. In order to produce the proper wearing characteristics and concentration of sparks, the width of the housing material between each adjacent barrel of the plurality of misch metal barrels 6, and the width of the housing material between the barrels and edges of the housing, are of critical importance.

Preferably, as shown in FIG. 1, a width w1 of the housing material located between adjacent barrels 6 is preferably at most 1/3 of the diameter of the misch metal barrel. Most preferably, the width w1 of the housing material located between adjacent barrels 6 is approximately 1/6 of the diameter of the barrels. Likewise, a width w2 of the housing material between the barrels 6 and edges 7 and 9 of the housing is also preferably at most 1/3 of the diameter of the barrels, and most preferably approximately 1/6 of the diameter of the barrels.

In other words, if the diameter of a misch metal barrel is 3/8 of an inch, then the maximum width of the housing material between adjacent misch metal barrels is 1/8 of an inch, and most preferably 1/16 of an inch. Similarly, if the diameter of a misch metal barrel is 3/8 of an inch, then the maximum width of the housing material between the barrel and edges of the housing is 1/8 of an inch, and most preferably 1/16 of an inch.

As used herein, the term diameter is not intended to limit the cross-sectional shape of the misch metal barrels to a circular shape. As such, the cross-sectional shape of the misch metal barrels can be other geometric shapes, such as square, rectangular, octagonal or the like. When the cross-sectional shape is other than circular, the "diameter" of the misch metal barrels is defined as any single measurement across the cross-sectional shape in any direction, an average of the measurements across the cross-sectional shape of the barrel, or any other similar measurement.

As shown in FIG. 3, the spark emitting device 1 is preferably designed to be attached to the bottom surface 10 of a skateboard 8 via double-sided tape 12. The tape 12 preferably has two purposes. First, it holds the housing 2 of the spark emitting device 1 to the underside 10 of the skateboard 8. Second, as shown in FIG. 2, it can also hold the misch metal barrels 6 in place within the openings 4 in the housing 2. Preferably, the double-sided adhesion tape 12 is instantly able to adhere to dirty surfaces, wood or paint, as well as metal. In addition, the tape 12 is preferably of a high-temperature tolerance so as not to melt while the spark-emitting device 1 is in use. Because double-sided tape 12 is used, the spark-emitting device 1 of the present invention is designed as a disposable product which can be replaced when fully worn or otherwise.

Although FIG. 2 shows that the tape 12 assists in holding the misch metal barrels 6 in place within the housing openings 4, the housing can be designed to hold the barrels 6 in place without interaction with the tape 12. Therefore, the housing openings 4 need not extend completely through from the upper surface 3 to the lower surface 5 of the housing 2. To hold the misch metal barrels 6 in place within the openings, the openings 4 can be designed with internal ridges which secure the barrels in place. These internal ridges can also be used in combination with the tape 12 described above.

Preferably, as shown in FIG. 1, the housing 2 is designed to have a multiple platform profile. In particular, it is preferred that the housing 2 have an upper platform 14 and a lower platform 16. The upper platform 14 is designed to hold the misch metal barrels 6 and is preferably 1/4 of an inch thick. The lower platform 16 is preferably no more than 1/16 of an inch thick and of sufficient flexibility so that when in use, the housing 2 will flex on the skateboard 8 and thus prevent the housing 2 from dislodging and popping off of the skateboard 8.

In addition, in order to universally accommodate all skateboards manufactured, the housing 2 preferably has a six degree radius on a front-face 18 thereof, so that the housing 2 is not subject to snagging and falling off the skateboard under use.

The misch metal barrels 6 are preferably comprised of a special alloy of cerium and lanthanum which creates a sparking effect when in contact with abrasive surfaces. Preferably, the misch metal barrels 6 have a chemical formula consisting essentially of 20% iron; 2% magnesium; 40% cerium; 18% lanthanum; 15% neodymium; and 5% praseodymium. In addition, the spark emitted from a device can be changed to any various number of colors by using different color-emitting alloy compositions, such as, for example, strontium to produce a red or pink colored spark. Because the barrels are capable of emitting various colors, the user can interchange the barrels within the housing to create various spark color patterns and provide a customized spark emitter.

Although the foregoing describes that the spark-emitting device is attached to a skateboard, it will be readily apparent that the spark-emitting device can be used on other wheeled recreational structures, such as roller skates and rollerblades, to name a few. Accordingly, although the present invention has been described in relation to particular embodiments thereof, many other variations and modifications and other uses will become apparent to those skilled in the art. It is preferred, therefore, that the present invention be limited not by the specific disclosures herein, but only by the appended claims.

What is claimed is:

1. A spark emitting device, the spark emitting device comprising:

a housing having an upper surface, a lower surface and a plurality of openings which extend from the upper surface proximate to the lower surface;

a respective metal component comprising misch metal inserted in each of the openings in the housing, the respective metal components creating a sparking effect when contacting an abrasive surface; and a double-sided adhesive layer coupled to the lower surface of the housing, wherein a width of the housing surrounding each of the metal components is a maximum of approximately 1/3 of a diameter of the metal component and wherein the housing is composed of a plastic material chosen to wear at substantially the same rate as the metal components, and wherein the housing comprises a multiple platform profile including an upper platform and a lower platform each having a flat top side and a flat bottom side, the bottom side of the upper platform and the bottom side of the lower platform defining the lower surface of the housing and being parallel to one another, and the top side of the upper platform and the top side of the lower platform defining the upper surface of the housing and being parallel to one another on separate planes, the upper platform being positioned on one side of the housing and the lower platform being positioned on an opposing side of the housing, the respective metal components being positioned in the upper platform, and the lower platform being structured thinner than the upper platform and able to flex in response to the housing contacting the abrasive surface.

2. The spark emitting device according to claim 1, wherein the plurality of openings extend to the lower surface of the housing, and the spark emitting device further comprises double-sided tape attached to the lower surface of the housing, the double-sided tape being dimensioned and positioned so as to hold the metal components in place within their respective openings in the housing.

3. The spark emitting device according to claim 1, wherein the plastic material is a polycarbonate material.

4. The spark emitting device according to claim 1, wherein the housing preferably wears no faster than 3/16 of an inch in 20 minutes of use under a 120 pounds of pressure.

5. The spark emitting device according to claim 1, wherein at least two of the metal components are comprised of alloys comprising misch metal which emit different color sparks when contacting the abrasive surface.

6. The spark emitting device according to claim 1, wherein the housing contains five openings arranged side by side.

7. The spark emitting device according to claim 1, wherein each of the metal components are 3/8 of an inch in diameter and 1/4 of an inch in depth.

8. The spark emitting device according to claim 1, wherein the metal components are spaced apart along an edge of the housing, the edge having a six degree radius.

9. A skateboard comprising:

a board;

a double-sided adhesive layer; and a spark emitting device coupled to the board by the double-sided adhesive layer, the spark emitting device comprising:

a housing having a multiple platform profile; and a plurality of metal components placed within the housing, the metal components comprising misch metal which create a sparking effect when contacting an abrasive surface, the plurality of metal components having a spacing therebetween of a maximum of approximately 1/3 of a diameter of the metal components and wherein the housing is composed of a plastic material chosen to wear at substantially the same rate as the metal components, wherein the multiple platform profile comprises an upper platform and a lower platform each having a flat top side and a flat bottom side, the bottom side of the upper platform and the bottom side of the lower platform being parallel to one another, and the top side of the upper platform and the top side of the lower platform being parallel to one another on separate planes, the upper platform being positioned on one side of the housing and the lower platform being positioned on an opposing side of the housing, the respective metal components being positioned in the upper platform, and the lower platform being structured thinner than the upper platform and able to flex in response to the housing contacting the abrasive surface.

10. The skateboard according to claim 9, wherein at least two metal components of the plurality of metal components are comprised of alloys which emit different color sparks when contacting the abrasive surface.

11. The skateboard according to claim 9, wherein each of the plurality of metal components are 1/3 of an inch in diameter and 1/4 of an inch in depth.

12. The skateboard according to claim 9, wherein the upper platform comprises a plurality of openings which extend from the top side of the upper platform proximate to the bottom side of the upper platform; and the plurality of metal components are each inserted into a respective one of the plurality of openings.

13. The skateboard according to claim 12, wherein the plurality of openings extend through the housing, and double-sided tape being so dimensioned and positioned so as to hold the metal components in place within their respective openings in the housing, and wherein the flexing of the lower platform facilitates the double-sided tape in holding the spark emitting device to the board.

14. The skateboard according to claim 12, wherein the plastic material is a polycarbonate material.

15. The skateboard according to claim 12, wherein the housing preferably wears no faster than 3/16 of an inch in 20 minutes of use under a 120 pounds of pressure.

16. The skateboard according to claim 12, wherein the metal components are spaced apart along an edge of the housing, the edge having a six degree radius.

* * * * *

UNITED STATES PATENT AND TRADEMARK OFFICE

CERTIFICATE OF CORRECTION

PATENT NO. : 7,942,428 B2
APPLICATION NO. : 10/934721
DATED : May 17, 2011
INVENTOR(S) : Gregory Scott Starr It is certified that error appears in the above-identified patent and that said Letters Patent is hereby corrected as shown below:

Column 6, Lines 31-32 Claim 13 should read --...and the double-sided tape...--

Signed and Sealed this
Twenty-eighth Day of June, 2011

David J. Kappos

David J. Kappos
*Director of the United States Patent and Trademark Office*